US008063584B2

(12) United States Patent
Inukai

(10) Patent No.: US 8,063,584 B2
(45) Date of Patent: Nov. 22, 2011

(54) LIGHT OUTPUT DEVICE AND IMAGE FORMING APPARATUS INCLUDING THE SAME

(75) Inventor: Katsumi Inukai, Iwakura (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 414 days.

(21) Appl. No.: 12/405,382

(22) Filed: Mar. 17, 2009

(65) Prior Publication Data

US 2009/0237001 A1 Sep. 24, 2009

(30) Foreign Application Priority Data

Mar. 20, 2008 (JP) ..... 2008-072662

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl. ..... 315/291; 315/209 R; 315/307

(58) Field of Classification Search ..... 315/209 R, 315/209 CD, 230, 234, 238, 291, 307
See application file for complete search history.

(56) References Cited

U.S. PATENT DOCUMENTS 5,744,912 A * 4/1998 So ..... 315/127

FOREIGN PATENT DOCUMENTS

| | | |
|---|---|---|
| JP | 58-187888 | 12/1983 |
| JP | 62-047181 | 2/1987 |
| JP | 63-98672 | 6/1988 |
| JP | 04-060558 | 2/1992 |
| JP | 05-088785 | 4/1993 |
| JP | 05-131675 | 5/1993 |
| JP | 06-029807 | 2/1994 |
| JP | 06-090525 | 3/1994 |
| JP | 06-187253 | 7/1994 |
| JP | 07-200329 | 8/1995 |
| JP | 07-244452 | 9/1995 |
| JP | 08-300727 | 11/1996 |
| JP | 09-307416 | 11/1997 |

OTHER PUBLICATIONS

Notification of Reasons for Refusal for Japanese patent application No. 2008-072662 mailed Feb. 10, 2011.

* cited by examiner

*Primary Examiner* — Anh Tran
(74) *Attorney, Agent, or Firm* — Banner & Witcoff, Ltd.

(57) ABSTRACT

A light output device includes a feedback-signal generating unit configured to generate a feedback control signal for maintaining output power of the light at a predetermined value. The feedback-signal generating unit generates the feedback control signal in a gradually rising manner and supplies the generated feedback control signal to the output unit so that output power of the light is gradually increased at a time of power-on. The light output device also includes a discharge circuit configured to discharge a charge stored in the feedback-signal generating unit and thereby accelerate decrease of the feedback control signal and a power-voltage monitoring circuit configured to monitor a voltage of the power supplied to the output unit. The power-voltage monitoring circuit, upon detecting shutdown of the power, controls the discharge circuit and thereby causes discharge of the charge stored in the feedback-signal generating unit.

10 Claims, 7 Drawing Sheets

LIGHT OUTPUT DEVICE AND IMAGE FORMING APPARATUS INCLUDING THE SAME

CROSS REFERENCE TO RELATED APPLICATION

This application claims priority from Japanese Patent Application No. 2008-072662 filed Mar. 20, 2008. The entire content of this priority application is incorporated herein by reference.

TECHNICAL FIELD

The present invention relates to a light output device and an image forming apparatus including the device. Specifically, the present invention relates to protection of a light output unit of the light output device.

BACKGROUND

It is a known art to, at a time of opening a cover, shut down power of a laser diode and detect the cover open via software. In this art, while a photosensitive drum and a conveying unit are driven by motor operation, the motor operation is stopped not only at a motor driving power source side but also at a motor control circuit side by the detection of an open cover via software. Therefore, double protective functions work for the motor operation.

Moreover, it is also known in the art to stop an output unit having such a diode upon detecting the cover open via software.

However, with the known art, at the time of shutting down the power, while the power shutdown causes decrease of output, control to increase the decreased output is attempted until the power shutdown is detected via software. This can accelerate deterioration of the output unit (the laser diode). Furthermore, in a case where the power is returned before the power shutdown is detected via software, control to increase the output is likewise attempted and, further, in a case of failing to detect the power shutdown and return via software and causing repeat of this operation, deterioration of the output unit can be still more accelerated.

Therefore, there is a need in the art to suitably prevent the output unit from deterioration due to the power shutdown and the like.

SUMMARY

One aspect of the present invention is a light output device including an output unit configured to output light from a light source, a feedback-signal generating unit configured to generate a feedback control signal for maintaining output power of the light at a predetermined value. The feedback-signal generating unit generates the feedback control signal in a gradually rising manner and supplies the generated feedback control signal to the output unit so that output power of the light is gradually increased at a time of power-on. The light output device also includes a controller configured to set the predetermined value of the output power and control output of the output unit, a discharge circuit configured to discharge a charge stored in the feedback-signal generating unit and thereby accelerate decrease of the feedback control signal, and a power-voltage monitoring circuit configured to monitor a voltage of the power supplied to the output unit and detect shutdown or return of the power. The power-voltage monitoring circuit, upon detecting shutdown of the power, controls the discharge circuit and thereby causes discharge of the charge stored in the feedback-signal generating unit.

With this aspect of the present invention, the feedback control signal for maintaining the light output power is generated in the gradually rising manner. Therefore, in a case where, for example, the feedback control signal is generated based on a PWM signal, a ripple component due to the PWM signal can be reduced. Furthermore, at a time of power shutdown, by the control of the power-voltage monitoring circuit, the charge stored in the feedback-signal generating unit is discharged with use of the discharge circuit and, thereby, decrease of the feedback control signal is accelerated. Therefore, at the time of power shutdown, output of the light from the output unit by the charge remaining in the feedback-signal generating unit is prevented. That is, light can be turned off at the time of power shutdown. This results in suitable preservation of the output unit such as a laser diode (light source) due to power shutdown or the like.

DETAILED DESCRIPTION

<An Illustrative Aspect>

1. Configuration of Image Forming Apparatus

An illustrative aspect in accordance with the present invention will be described with reference to FIGS. 1 through 7.

Figure 1:
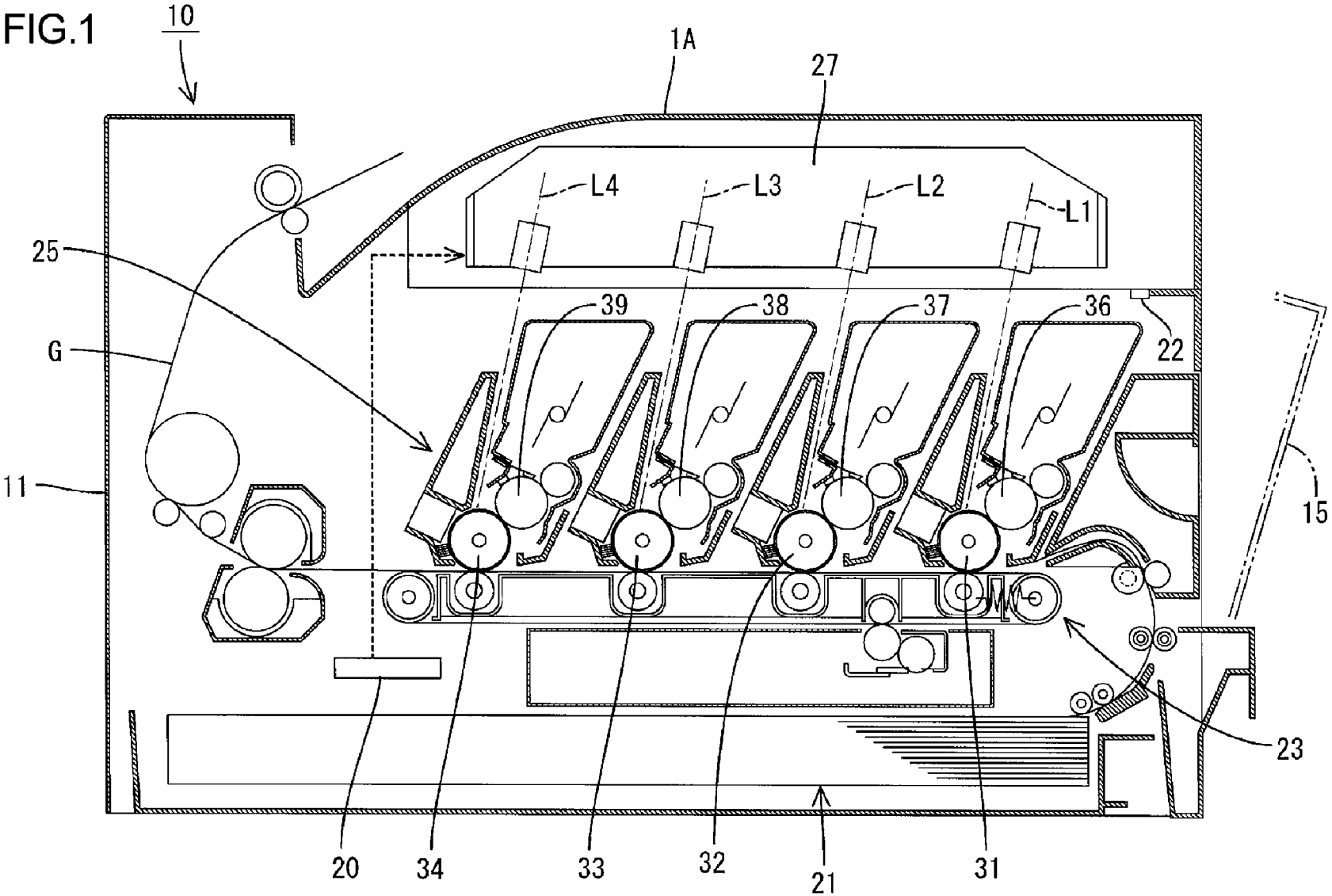
FIG. 1 is a side cross-sectional view of an illustrative aspect of a laser printer in accordance with the present invention.

FIG. 1 is a side cross-sectional view schematically showing a configuration of an illustrative aspect of an image forming apparatus in accordance with the present invention. Here, the image forming apparatus is illustratively adopted as a laser printer 10.

The laser printer 10 is a so-called direct-tandem color laser printer. The laser printer 10 includes four photosensitive drums 31, 32, 33, 34 and respective four developer rollers 36, 37, 38, 39, each of which corresponds to a color (for example, black, cyan, magenta, and yellow). Note that hereinafter the front side is represented by the right side in FIG. 1. Note also that the image forming apparatus is not limited to the color laser printer; for example, the image forming apparatus may be a monochromatic laser printer or a multi-function machine having a facsimile function and a copy function.

The laser printer 10 includes a body casing 11 having a box shape. Disposed in the body casing 11 are a sheet feeder 21, a light output device 20, a sheet conveyer 23, an image forming mechanism 25, and a scanner 27. The sheet conveyer 23 can convey sheets (each an illustration of a recording media; herein sheet is broadly defined as paper, plastic, and the like). The image forming mechanism 25 can form images with use of light outputted from the light output device 20. The image forming mechanism 25 also includes photosensitive drum 31, 32, 33, 34, the developer rollers 36, 37, 38, 39, and the like.

The body casing 11 has an access opening in the front face thereof. The access opening allows access to the image forming mechanism 25. A front cover 15 (an illustration of a cover) is disposed on the access opening. The front cover 15 can pivot so as to open and close the access opening. Furthermore, a mechanical interlock switch 22 (an illustration of a power switching unit) is disposed adjacent to the front cover 15. The interlock switch 22 can operate in a manner interlocking with operation of the front cover 15. The interlock switch 22 can shut down at least power supplied to a part of the light output device 20 upon open of the front cover 15 and can return at least the power upon close of the front cover 15.

Polygon mirrors (not shown in figures) and four laser diodes LD1 to LD4 (each an illustration of a "light source") are accommodated in the scanner 27. Each of the laser diodes LD1 to LD4 is one member of the light output device 20 and corresponds to a respective color. The laser diodes LD1 to LD4 emit laser lights L1 to L4 (each an illustration of "light"), respectively. The emitted laser lights L1 to L4 are deflected by the respective polygon mirrors (not shown in figures) and pass through respective fθ lenses (not shown in figures). Thereafter, the laser lights L1 to L4 are turned by respective optical components such as reflecting mirrors disposed in the light paths each, and irradiated to the respective surfaces of the photosensitive drums 31, 32, 33, 34 by high-speed scanning as shown in FIG. 1. Thus, an electrostatic latent image is formed on each of the photosensitive drums. Thereafter, developing process, transfer process, and fixing process are performed to form an image on the sheet sent through a sheet-conveying path G. The sheet after the image is formed thereon is released onto a sheet-exit tray provided on a top wall 11A of the body casing 11.

The laser printer 10 has a normal mode for performing normal print process and a toner save mode for reducing toner consumption. When switching between the normal mode and the toner save mode, the laser printer 10 changes output power of the laser lights L1 to L4 emitted by the light output device 20 from the respective laser diodes LD1 to LD4.

2. Configurations of Light Output Device

Figure 2:
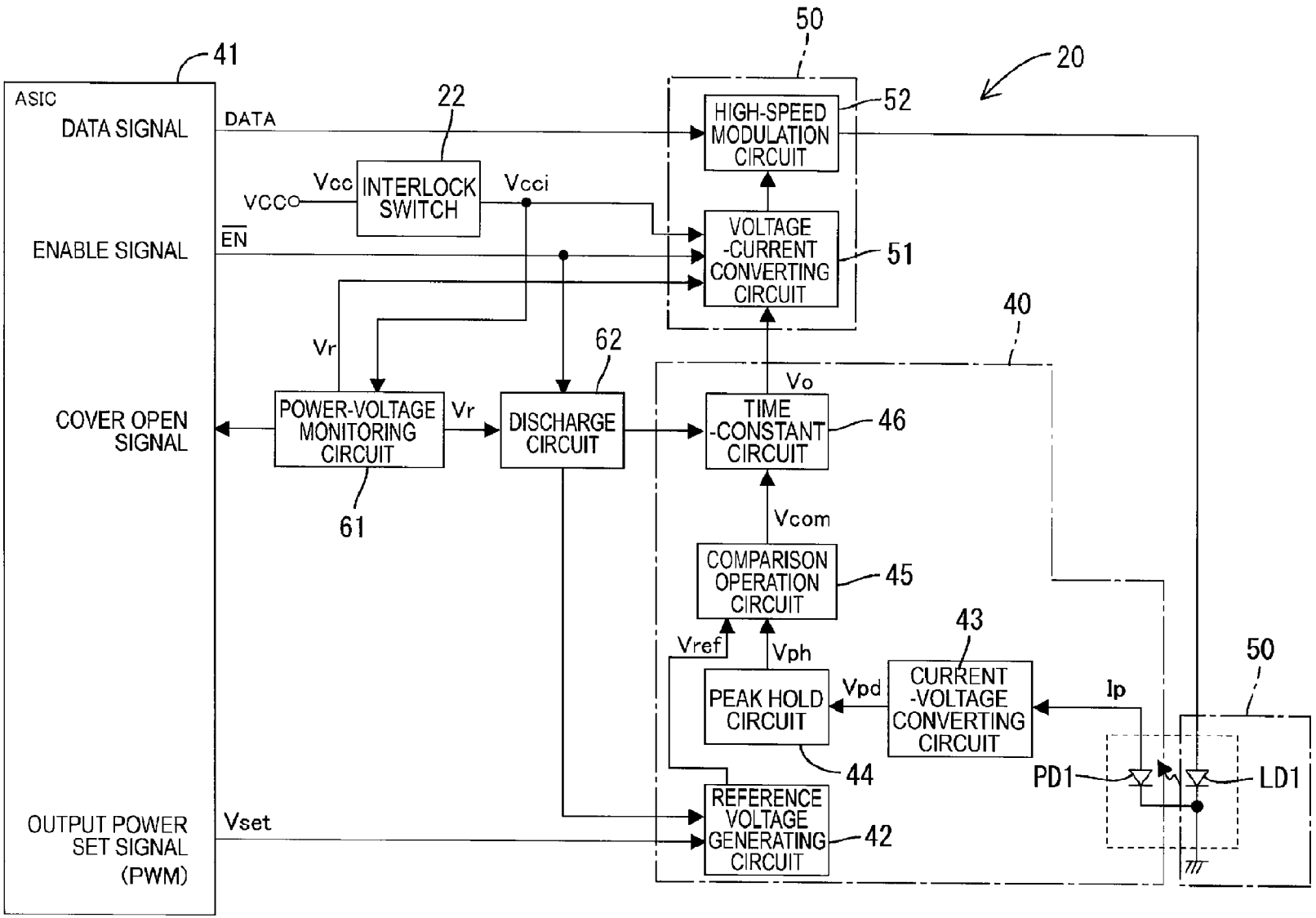
FIG. 2 is a block diagram of a light output device of the laser printer.

Next, a circuit configuration of this illustrative aspect of the light output device 20 in accordance with the present invention will be described with reference to FIGS. 2 and 3. In this illustrative aspects, the light output device 20 is illustratively provided in the laser printer 10 (an illustration of the "image forming apparatus"). Furthermore, while the circuit configuration (excluding a control circuit 41) of the light output device 20 is provided separately and correspondingly to each of the four laser diodes LD1 to LD4 of the laser printer 10, the configurations for the laser diodes LD1 to LD4 each are identical. Therefore, FIG. 2 shows only the configuration for the laser diode LD1. In this illustrative aspect, the control circuit 41 (an illustration of a "controller") is shared by the laser diodes LD1 to LD4. Note that the light output device 20 is not limited to the illustration provided in the laser printer 10. Likewise, the light source is not limited to the laser diodes LD1 to LD4.

The light output device 20 generally includes an output unit 50, the control circuit 41, a feedback-signal generating unit 40, a discharge circuit 62, and a power-voltage monitoring circuit 61.

The output unit 50 outputs the laser light L1 from the laser diode LD1. The control circuit 41 controls output of the output unit 50. The feedback-signal generating unit 40 generates a feedback control signal Vo for maintaining output power of the laser light L1 at a predetermined value. Furthermore, the feedback-signal generating unit 40 generates the feedback control signal Vo in a gradually rising manner and supplies the generated feedback control signal Vo to the output unit 50 so that the output power of the laser light L1 is gradually increased at a time of power-on of power (voltage) Vcc.

The discharge circuit 62 discharges the charge stored in the feedback-signal generating unit 40 and thereby accelerates decrease of the feedback control signal Vo. The power-voltage monitoring circuit 61 monitors the power Vcc for the output unit 50 and detects shutdown or return of the power Vcc. The power-voltage monitoring circuit 61, upon detecting shutdown of the power Vcc, controls the discharge circuit 62 and thereby causes discharge of the charge stored in the feedback-signal generating unit 40.

The configuration of the light output device 20 will hereinafter be more specifically described. As shown in FIG. 2, the output unit 50 has a voltage-current converting circuit 51, a high-speed modulation circuit 52, and a laser diode LD1.

The feedback-signal generating unit 40 has a light detecting unit, a reference-voltage generating circuit 42, a comparison operation circuit 45, a time-constant circuit 46, and a photodiode PD1. The light detecting unit of the feedback-signal generating unit 40 generates light detection signals (Ip, Vpd, Vph) corresponding to the output power of the laser light L1. The light detecting unit has the photodiode PD1, a current-voltage converting circuit 43, and a peak hold circuit 44.

The photodiode PD1 receives the laser light L1 from the laser diode LD1, generates a light detection current (signal) Ip according to greatness of light intensity of the laser light, and outputs the light detection current Ip to the current-voltage converting circuit 43. The photodiode PD1 is, for example, sealed in a same package with the laser diode LD1, with the cathode of the laser diode LD1 and the cathode of the photodiode PD1 having a common connection to the ground.

The current-voltage converting circuit 43 receives the light detection current Ip, converts the light detection current Ip into a light detection voltage Vpd, and supplies the light detection voltage (signal) Vpd to the peak hold circuit 44. As shown in FIG. 3, the current-voltage converting circuit 43 is configured by, for example, a single resistor R4 that is connected between the ground and the anode of the photodiode PD1.

The peak hold circuit 44 receives the light detection voltage Vpd and holds its peak value for a predetermined time. As shown in FIG. 3, the peak hold circuit 44 has, for example, an operational amplifier (hereinafter referred to as the "op-amp") OP2. The op-amp OP2 receives the light detection voltage Vpd at its non-inverting input terminal. The anode of a diode D3 is connected to the output terminal of the op-amp OP2. The cathode of the diode D3 is connected to the inverting input terminal of the op-amp OP2. A capacitor C3 and a resistor R3 are also connected to the cathode of the diode D3, while the other terminal of each of the capacitor C3 and the resistor R3 is grounded. With such a configuration of the peak hold circuit 44, when the capacitor C3 is being charged, the peak value of the light detection voltage Vpd is held by the capacitor C3 electrode which is connected to the cathode of the diode D3 so that a hold voltage (signal) Vph is formed. The hold voltage (signal) Vph is supplied to the comparison operation circuit 45.

In this illustrative aspect, the control circuit 41 is configured by, for example, an ASIC (application specific integrated circuit). In order to control output of the output unit 50, the control circuit 41 generates a set signal Vset for setting a reference voltage Vref and supplies the set signal Vset to the reference-voltage generating circuit 42. In this illustrative aspect, the set signal Vset is, for example, a PWM (Pulse Width Modulation) signal. By setting the pulse width of the PWM signal at a predetermined value, the reference voltage Vref of the reference-voltage generating circuit 42 is set, and the output power of the laser diode LD1 is set.

The reference-voltage generating circuit 42 receives the set signal Vset, gradually raises the set signal Vset by a first time constant τ1 to generate the reference voltage Vref. The reference voltage Vref is supplied to the comparison operation circuit 45. As shown in FIG. 3, the reference-voltage generating circuit 42 has a resistor R1 and a capacitor C1, and the first time constant τ1 is τ1=R1*C1.

The comparison operation circuit 45 compares the hold voltage (the voltage of the light detection signal) Vph with the reference voltage Vref, and generates a comparison signal Vcom corresponding to their difference. Here, when the reference voltage Vref is greater than the hold voltage Vph, the comparison operation circuit 45 generates a comparison signal Vcom for increasing the output power of the laser light. The comparison signal Vcom is supplied to the time-constant circuit 46. As shown in FIG. 3, the comparison operation circuit 45 has, for example, an operational amplifier (op-amp) OP1, a resistor R5, and a resistor R6. The inverting input terminal of the op-amp OP1 is supplied with the hold voltage Vph through the resistor R5, while the non-inverting input of the op-amp OP1 is supplied with the reference voltage Vref. The resistor R6 is connected between the output terminal and the inverting input terminal of the op-amp OP1. The amplification degree of the op-amp OP1 is set by the resistor R5 and the resistor R6.

Figure 3:
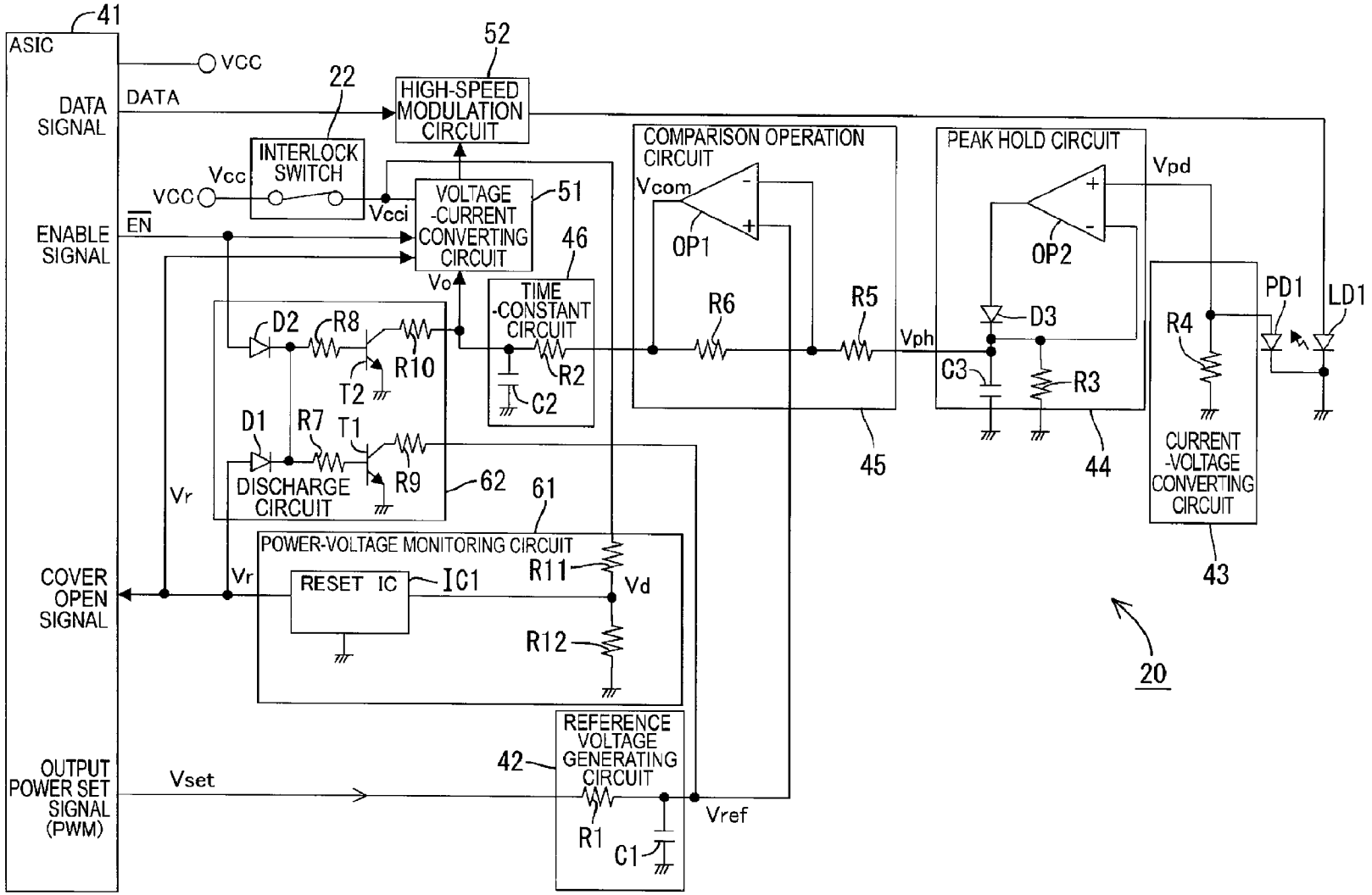
FIG. 3 is a schematic circuit diagram of the light output device.

As shown in FIG. 3, the time-constant circuit 46 has a resistor R2 and a capacitor C2 that determine a second time constant τ2. The time-constant circuit 46 receives the comparison signal Vcom from the comparison operation circuit 45, gradually raises the comparison signal Vcom by the second time constant τ2 (=R2*C2), and generates the feedback control signal Vo. The feedback control signal Vo is supplied to the output unit 50 or, specifically, to the voltage-current converting circuit 51 of the output unit 50.

Furthermore, while a power terminal VCC supplies the power Vcc to the voltage-current converting circuit 51, the interlock switch 22 is provided between the power terminal VCC and the voltage-current converting circuit 51. While the power Vcc passes through a power line, the interlock switch 22 opens the power line in a manner interlocking with open of the front cover 15, and closes the power line in a manner interlocking with closing operation of the front cover 15. Thus, when the front cover 15 is opened during supply of drive current to the laser diodes LD1 to LD4 (e.g. during printing operation), supply of the drive current to the laser diodes LD1 to LD4 is simultaneously stopped, and emission of the laser lights L1 to L4 are interrupted.

Also as shown in FIG. 3, the discharge circuit 62 has a first discharge circuit and a second discharge circuit. The first discharge circuit has a diode D1, a resistor R7, a transistor T1, and a resistor R9. The second discharge circuit has a diode D2, a resistor R8, a transistor T2, and a resistor R10. The resistor R9 of the first discharge circuit is connected to the capacitor C1 of the reference-voltage generating circuit 42. When the transistor T1 is turned on, a charge in the capacitor C1 is discharged through the resistor R9 and the transistor T1. Likewise, the resistor R10 of the second discharge circuit is connected to the capacitor C2. When the transistor T2 is turned on, charge in the capacitor C2 is discharged through the resistor R10 and the transistor T2.

Note that the cathode of the diode D1 and the cathode of the diode D2 are connected to each other, and thus the first discharge circuit and the second discharge circuit have a common connection. Therefore, the first discharge circuit and the second discharge circuit are simultaneously turned on/off by an enable signal EN or a reset signal Vr. In addition, the discharge circuit 62 has a faster discharge characteristic than the peak hold circuit 44. Therefore, charge stored in the reference-voltage generating circuit 42 and in the time-constant circuit 46 is discharged more rapidly than a charge stored in the peak hold circuit 44.

As shown in FIG. 3, the power-voltage monitoring circuit 61 has a reset integrated circuit IC1, a resistor R11, and a resistor R12. The resistor R11 is connected between the interlock switch 22 and the voltage-current converting circuit 51. A power (voltage) Vcci between the interlock switch 22 and the voltage-current converting circuit 51 is divided by the resistor R11 and the resistor R12 to generate a divided voltage Vd. The divided voltage Vd is supplied to the reset integrated circuit IC1. When, for example, the divided voltage Vd becomes equal to or lower than a predetermined value, the reset integrated circuit IC1 detects shutdown of the power Vcci and generates the reset signal Vr. The reset signal Vr is supplied to the voltage-current converting circuit 51 and to the discharge circuit 62. The reset signal Vr is supplied also to the control circuit 41 as a cover open signal. The control circuit 41 receives the cover open signal and, after a lapse of a predetermined time period, recognizes the open of the front cover 15 in accordance with predetermined software process.

Note that, in the above-described configuration of the light output device 20, at least the high-speed modulation circuit 52, the op-amp OP1 of the comparison operation circuit 45, the op-amp OP2 of the peak hold circuit 44, the power-voltage monitoring circuit 61, and the discharge circuit 62 are integrated in a single IC. Therefore, the light output device 20 is downsized, and the cost is reduced.

3. Operation and Effects of the Light Output Device

Next, operation and effects of the light output device 20 configured as above will be described with reference to time charts of FIGS. 4 through 7.

3-1. At a Time of Normal-State Operation

Figure 4:
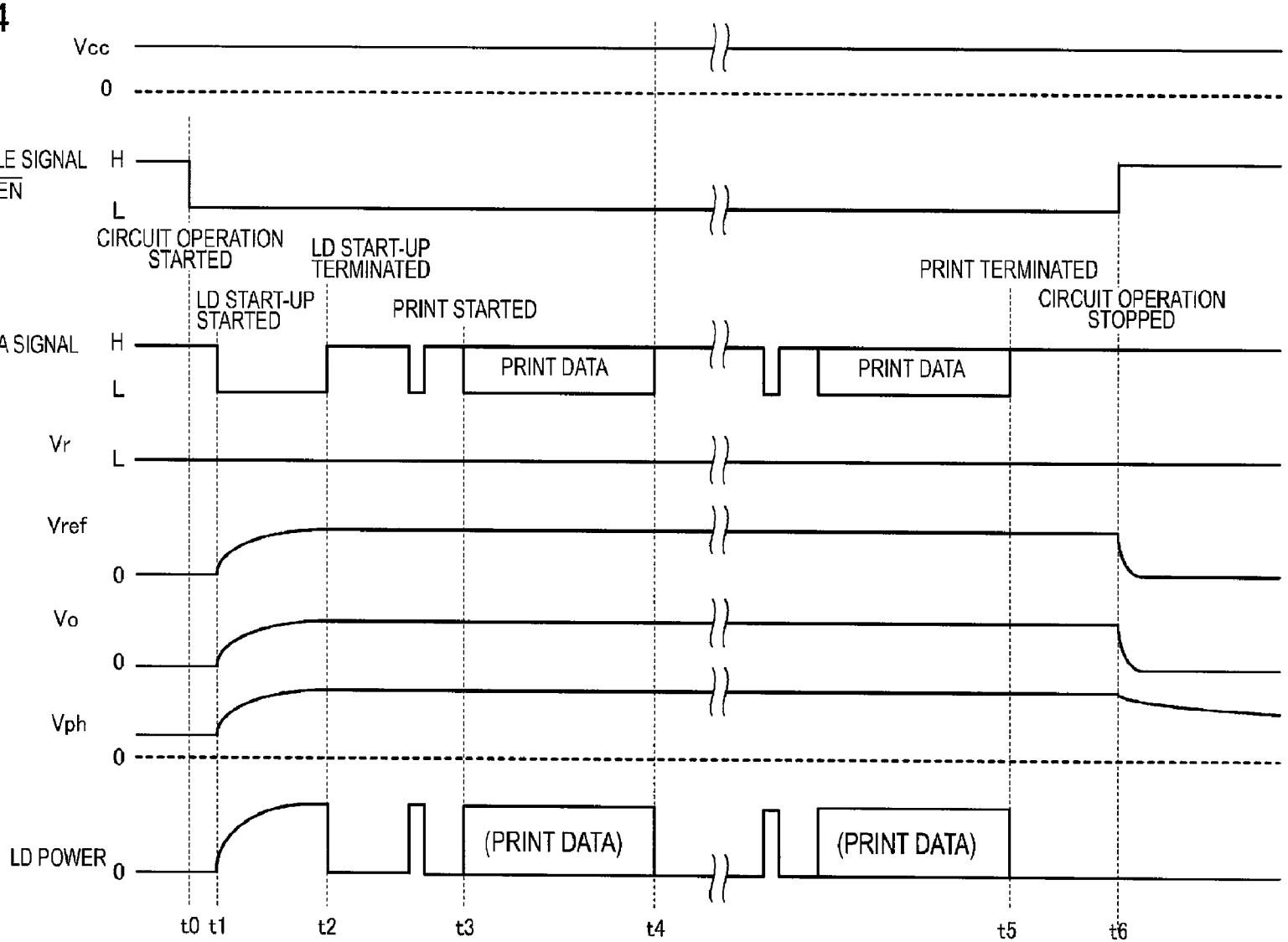
FIG. 4 is a time chart at a time of normal-state operation of the light output device.

FIG. 4 is a time chart showing a transition of each signal of the light output device 20 at a time of normal-state operation. Suppose a print request is made to the laser printer 10 at a time point t0 in FIG. 4. At this time, the control circuit 41 changes the enable signal EN (low active)(an illustration of a "disenable signal") from a logically high level to a logically low level. Then, circuit operation or, specifically, circuit operation of the voltage-current converting circuit 51 is started. That is, in this illustrative aspect, the operation of the voltage-current converting circuit 51 is activated when the enable signal EN is in the low level.

Next, when a DATA signal goes from high to low and start-up of the laser diode LD1 is started at a time point t1 in FIG. 4, the reference voltage Vref is gradually raised in accordance with the first time constant τ1 and, thereafter, is maintained at a predetermined value. Along with this, the feedback control signal Vo also is gradually raised in accordance with the second time constant T2 and, thereafter, is maintained at a predetermined value. Following this, each of the output power of the laser diode LD1 and the hold voltage Vph also is gradually raised and, thereafter, is maintained at a predetermined value. Then, when the DATA signal goes from low to high at a time point t2 in FIG. 4, the start-up of the laser diode LD1 is terminated, and the output power of the laser diode LD1 falls to zero.

Next, upon start of printing operation of a page at a time point t3 in FIG. 4, the DATA signal carrying print data information is supplied to the high-speed modulation circuit 52. The high-speed modulation circuit 52, in accordance with the DATA signal, modulates the feedback control signal Vo to generate a drive current signal (corresponding to a "modulation signal") for driving the laser diode LD1. The laser diode LD1 is driven by the drive current signal and emits the laser light L1 having the output power corresponding to each print data to the photosensitive drum 31. Then, the printing operation of the page is terminated at a time point t4 in FIG. 4.

Note that, as shown in FIG. 4, the DATA signal goes to low from high and the laser diode LD1 is driven also between the time point t2 and the time point t3. This intends to cause an optical sensor (not shown in figures) to detect the laser light L1 of the driven laser diode LD1. Because the laser light L1 is thus detected by the optical sensor and thereby the control circuit 41 can recognize the position scanned by the laser light L1, a start timing of the printing operation, i.e. the time point t3, can be suitably decided.

Then, when print operation of a requested number of pages according to the print request is terminated at a time point t5 in FIG. 4, the control circuit 41 changes the enable signal EN from the logically low level to the logically high level at a time point t6 in FIG. 4. Then, circuit operation or, specifically, circuit operation of the voltage-current converting circuit 51 is stopped. Because the enable signal EN is supplied also to the discharge circuit 62 at this time, the transistor T1 and the transistor T2 of the discharge circuit 62 are turned on, and the charge in the capacitor C1 of the reference-voltage generating circuit 42 and in the capacitor C2 of the time-constant circuit 46 is discharged. As a result, the reference voltage Vref and the feedback control signal Vo decrease more rapidly than the hold voltage Vph and becomes zero [V].

3-2. In a Case where Power is Turned Off During Printing Operation

Figure 5:
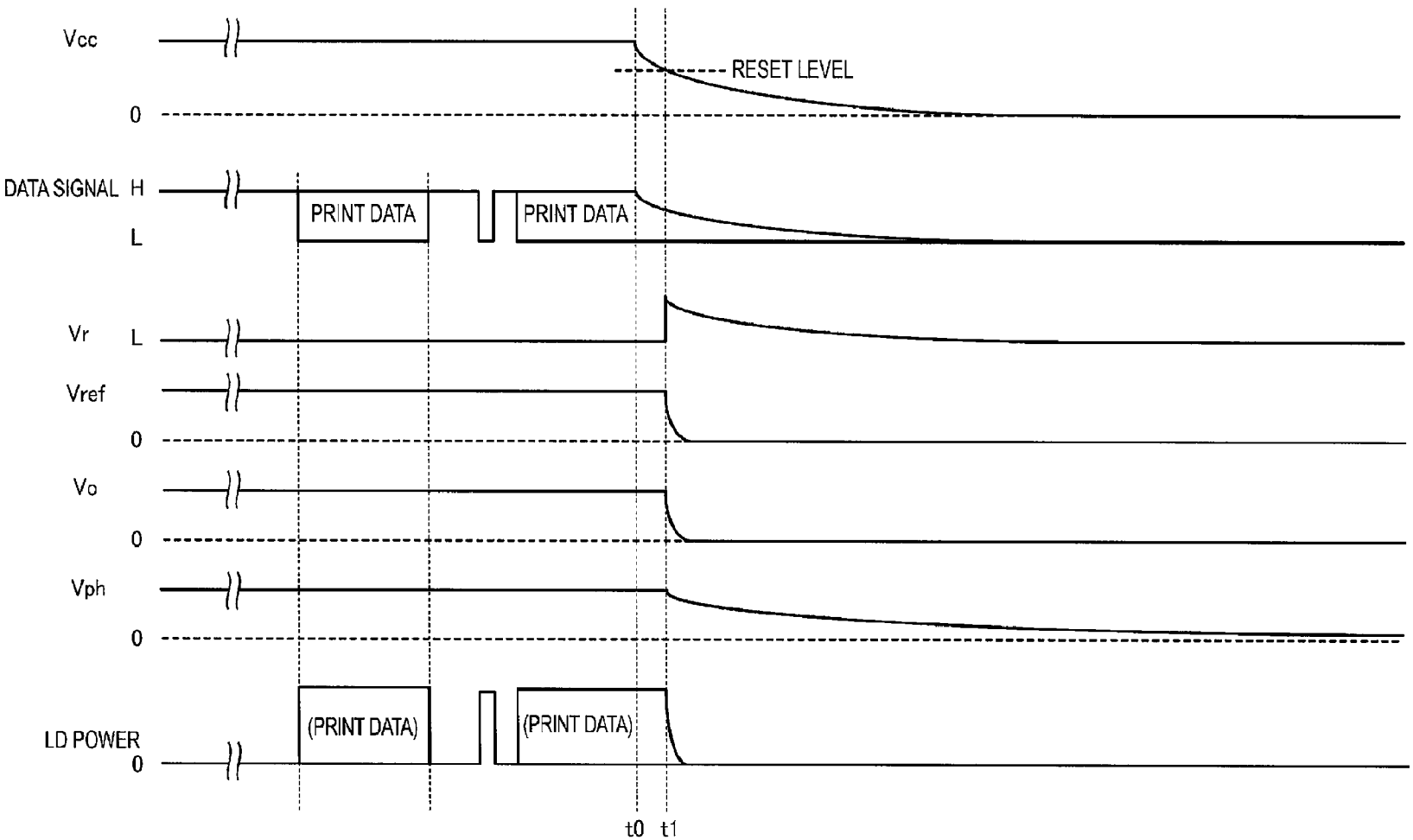
FIG. 5 is a time chart of the light output device in a case where power is turned off.

FIG. 5 is a time chart showing a transition of each signal of the light output device 20 in a case where power is turned off during printing operation.

Suppose the power Vcc is turned off at a time point t0 shown in FIG. 5. At this time, the power voltage Vcc decreases and, at a time point t1 shown in FIG. 5, decreases to a level where its shutdown is detected by the power-voltage monitoring circuit 61. Then, the reset integrated circuit IC1 of the power-voltage monitoring circuit 61 raises the reset signal Vr to a level that is active for turning on the transistors T1, T2 of the discharge circuit 62. Note that the level of detecting shutdown of the power Vcc by the power-voltage monitoring circuit 61 is determined as a detection level where the reset signal Vr can be raised to that active level.

By raising the reset signal Vr to the active level, the transistors T1, T2 of the discharge circuit 62 are turned on, and the charge in the capacitor C1 of the reference-voltage generating circuit 42 and in the capacitor C2 of the time-constant circuit 46 is discharged. At this time, as described above, because the discharge circuit 62 has the discharge characteristic more rapid than the peak hold circuit 44, the reference voltage Vref decreases more rapidly than the hold voltage Vph and, thereby, the feedback control signal Vo also decreases more rapidly than the hold voltage Vph. Accordingly, responding to decrease of the power voltage Vcc, the LD power also decreases rapidly in accordance with the decreasing speed of the feedback control signal Vo. As a result of this, even in the case where the power Vcc is turned off during printing operation, output of the laser light L1 from the laser diode LD1 by the charge remaining in the feedback-signal generating unit 40 is prevented. That is, the laser light L1 can be rapidly turned off at the time of shutdown of the power Vcc. As a result of this, deterioration of the output unit 50 such as the laser diode LD1 due to shutdown of the power Vcc can be suitably prevented.

3-3. In a Case where Front Cover is Opened

Figure 6:
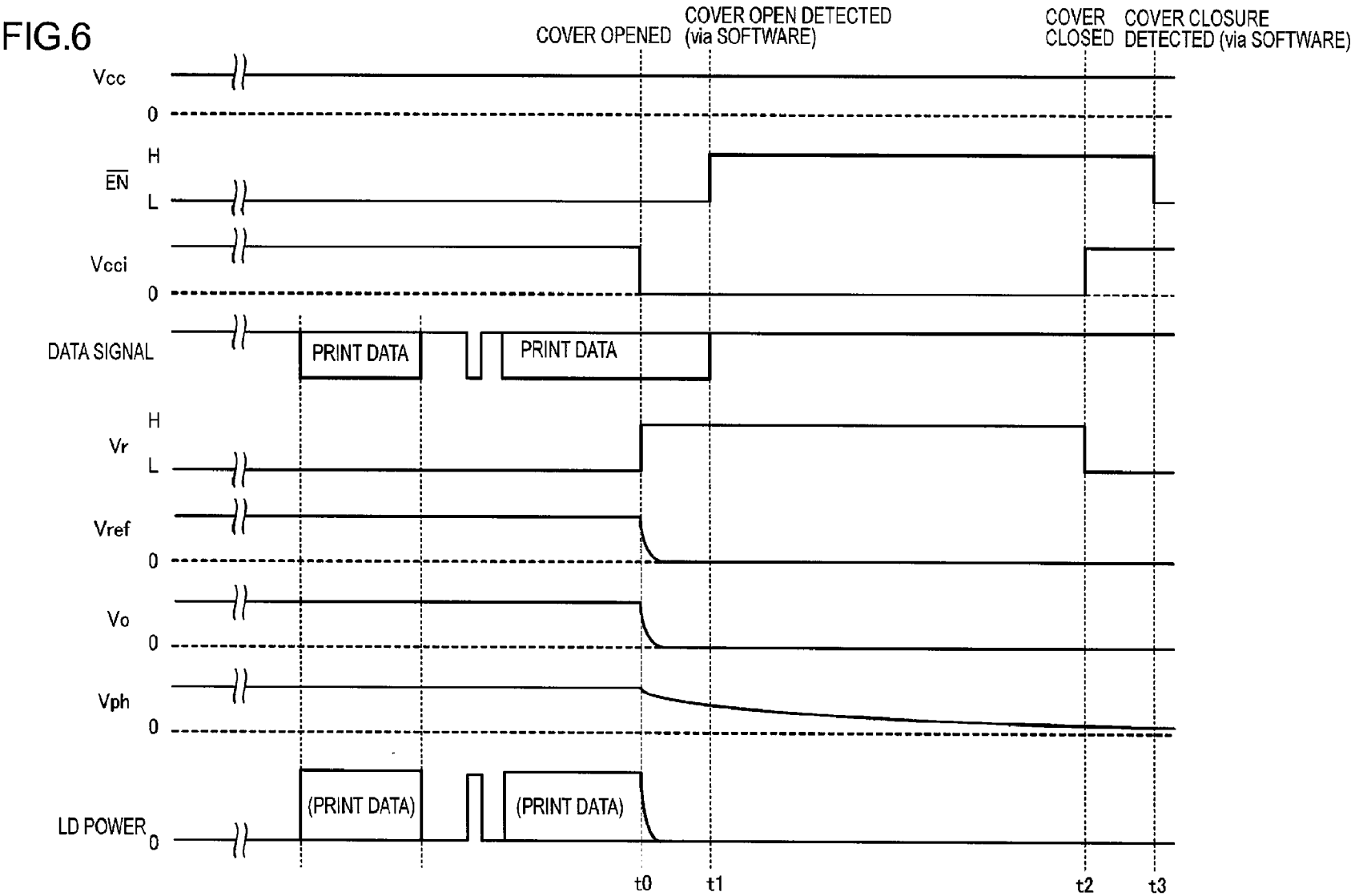
FIG. 6 is a time chart of the light output device in a case where a front cover is opened.

Next, FIG. 6 is a time chart showing a transition of each signal of the light output device 20 in a case where the front cover 15 is opened during supply of the power voltage Vcc and the interlock switch 22 is turned off.

Suppose that during supply of the power voltage Vcc, the front cover 15 is opened at a time point t0 shown in FIG. 6 and the interlock switch 22 is turned off. At this time, the power voltage Vcci between the interlock switch 22 and the voltage-current converting circuit 51 substantially instantaneously falls to zero [V]. Accordingly, the reset integrated circuit IC1 of the power-voltage monitoring circuit 61 raises the reset signal Vr substantially at the time point t0.

Then, by raising the reset signal Vr to a high level, the transistors T1, T2 are turned on, and the charge in the capacitor C1 and in the capacitor C2 is discharged. At this time, the reference voltage Vref decreases more rapidly than the hold voltage Vph and, thereby, the feedback control signal Vo also decreases more rapidly than the hold voltage Vph. Accordingly, responding to decrease of the power voltage Vcci, the LD power also decreases rapidly in accordance with the decreasing speed of the feedback control signal Vo. As a result of this, even in the case where the front cover 15 is opened and the interlock switch 22 is turned off, output of the laser light L1 from the laser diode LD1 by the charge remaining in the feedback-signal generating unit 40 is prevented. That is, the laser light L1 can be rapidly turned off at the time of opening the front cover 15. As a result of this, deterioration of the output unit 50 such as the laser diode LD1 due to opening the front cover 15 can be suitably prevented.

Next, when the control circuit 41 detects the opening of the front cover 15 via software based on the reset signal Vr at a time point t1 in FIG. 6, the enable signal EN is raised to the high level to stop the circuit operation of the voltage-current converting circuit 51 and the like.

Thereafter, when the front cover 15 is closed at a time point t2 in FIG. 6, the interlock switch 22 is turned on. Thus, the power voltage Vcci is supplied to the voltage-current converting circuit 51, and the reset signal Vr is fallen. Thereafter, when the control circuit 41 detects closure of the front cover 15 via software based on the reset signal Vr at a time point t3 in FIG. 6, the enable signal EN is fallen to the low level to activate the circuit operation of the voltage-current converting circuit 51 and the like. Then, after the time point t3 in FIG. 6, a printing operation similar to the above-described operation after the time point t0 in FIG. 4 is performed.

3-4. In a Case Where Front Cover is Opened and Closed in a Short Time

Figure 7:
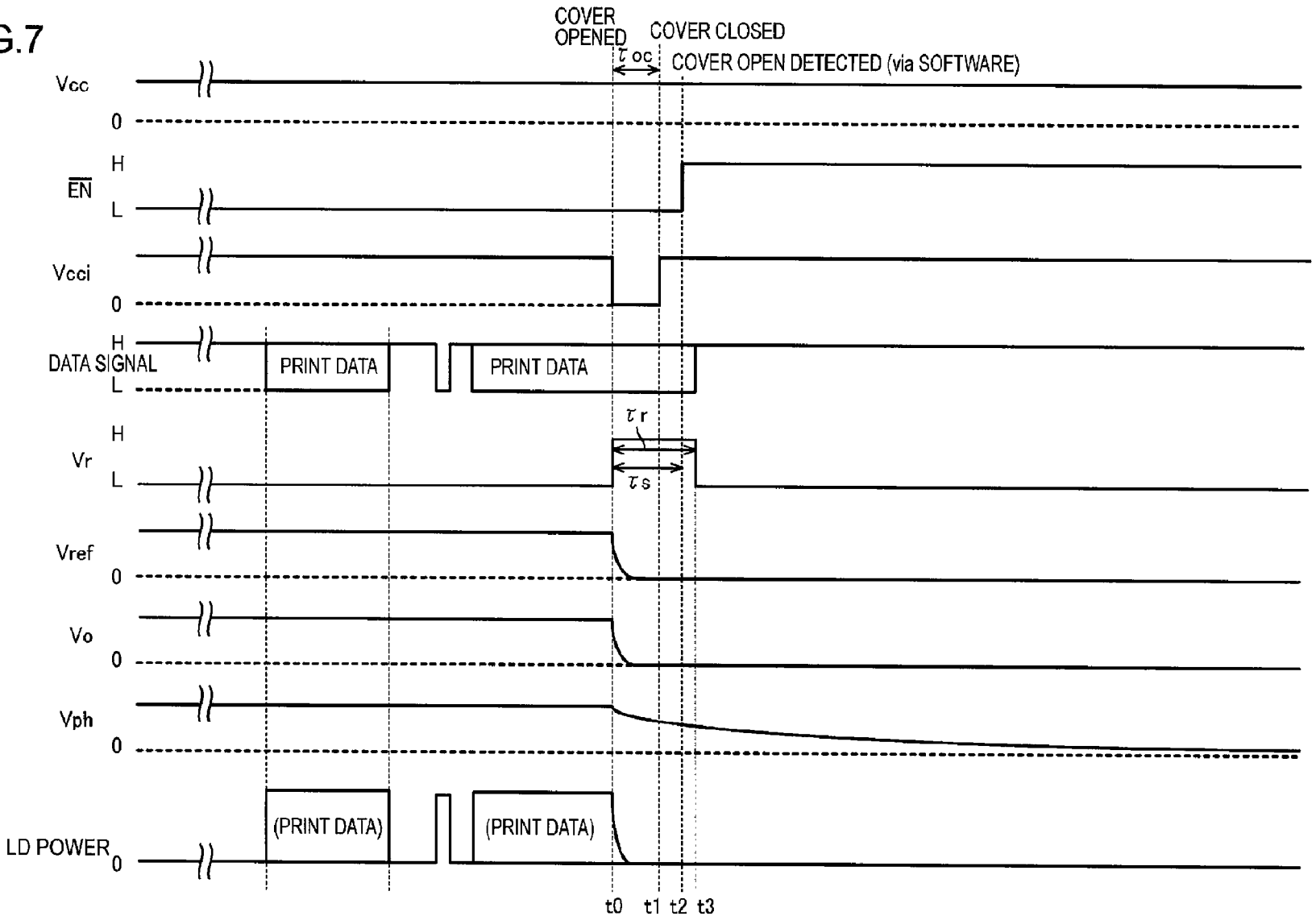
FIG. 7 is a time chart of the light output device in a case where the front cover is opened and closed.

Next, FIG. 7 is a time chart showing a transition of each signal of the light output device 20 in a case where the front cover 15 is opened during supply of the power voltage Vcc, the interlock switch 22 is turned off, and, immediately thereafter, the front cover 15 is closed and the interlock switch 22 is turned on.

Suppose that the front cover 15 is opened at a time point t0 shown in FIG. 7 and the interlock switch 22 is turned off. At this time, similar to the case of FIG. 6, the power voltage Vcci between the interlock switch 22 and the voltage-current converting circuit 51 substantially instantaneously decreases to zero [V]. Accordingly, the reset integrated circuit IC1 of the power-voltage monitoring circuit 61 raises the reset signal Vr substantially at the time point t0.

Then, similar to the case of FIG. 6, by raising the reset signal Vr, the transistor T1 and the transistor T2 are turned on, and the charge in the capacitor C1 and in the capacitor C2 is discharged. At this time, the reference voltage Vref decreases more rapidly than the hold voltage Vph and, thereby, the feedback control signal Vo also decreases more rapidly than the hold voltage Vph. Accordingly, responding to decrease of the power voltage Vcci, the LD power also decreases rapidly in accordance with the decreasing speed of the feedback control signal Vo. As a result of this, similar to the case of FIG. 6, even in the case where the front cover 15 is opened and the interlock switch 22 is turned off, output of the laser light L1 from the laser diode LD1 by the charge remaining in the feedback-signal generating unit 40 is prevented. That is, the laser light L1 can be rapidly turned off at the time of opening the front cover 15. As a result of this, deterioration of the output unit 50 (such as the laser diode LD1) due to the opening of the front cover 15, can be suitably prevented.

Next, when the front cover 15 is closed at a time point t1 shown in FIG. 7 and the interlock switch 22 is turned on, because the reset signal Vr is still in the high level at this time point, there is no output of the laser light L1 from the laser diode LD1. That is, in the case where the power voltage Vcci becomes equal to or lower than the predetermined value and, immediately thereafter, the power voltage Vcci is returned, the power-voltage monitoring circuit 61 supplies the high-level reset signal Vr for resetting the operation of the voltage-current converting circuit 51 to the voltage-current converting circuit 51 for a predetermined time period $\tau r$.

That is, in this illustrative aspect, upon detection of open of the front cover 15, the voltage-current converting circuit 51 is reset by the reset signal Vr for the predetermined time period $\tau r$. This predetermined time period $\tau r$ is set at a time period that is at least longer than the time period $\tau s$ wherein the control circuit 41 can detect shutdown of the power Vcci via software based on the reset signal Vr. Therefore, even in a case where the front cover 15 is opened and closed within a time period $\tau oc$ wherein the control circuit 41 cannot detect via software, output of the laser light L1 from the laser diode LD1 in that response is not caused. As a result of this, increase of the output power of the laser light L1 due to open and closure of the front cover 15 in a short time period is prevented, and deterioration of the light source such as the laser diode LD1 can be prevented.

<Other Illustrative Aspects>

The present invention is not limited to the illustrative aspect described with reference to the drawings. For example, illustrative aspects as follows are also included within the scope of the present invention. Furthermore, various variations other than the following illustrative aspects are also possible to be within the scope of the invention.

(1) The above-described illustrative aspect may be varied so that, when the laser printer 10 switches from the normal mode to the toner-save mode, the control circuit 41 of the light output device 20 changes the power of the laser lights L1 to L4 emitted from the laser diodes LD1 to LD3. In this case, the control circuit 41 changes the setting of the reference voltage Vref of the reference-voltage generating circuit 42. Specifically, for example, the control circuit 41 modulates the pulse width of the set signal (PWM signal) Vset to change the reference voltage Vref, and thereby changes the power of the laser lights L1 to L4. Furthermore, when changing the setting of the reference voltage Vref, the control circuit 41 causes the discharge circuit 62 to discharge the charge stored in the feedback-signal generating unit 40.

Specifically, after termination of requested printing operation, the control circuit 41 sets the level of the enable signal EN at the high level to turn on the transistor T1 and the transistor T2 of the discharge circuit 62 to cause discharge of the charge in the capacitor C1 of the reference-voltage generating circuit 42 and the capacitor C2 of the time-constant circuit 46. Note that the discharge time period at that time is set at various times corresponding to toner saving levels.

Furthermore at that time, similar to the time point t6 shown in FIG. 4, the reference voltage Vref decreases more rapidly than the hold voltage Vph and, thereby, the feedback control signal Vo decreases more rapidly than the hold voltage Vph. Accordingly, in accordance with the decreasing speed of the feedback control signal Vo, the output power of the laser diode LD1 also decreases from the output power of the normal mode to the output power of the toner-save mode more rapidly in comparison with the case where there is no discharge operation of the discharge circuit 62.

As a result of this, in the laser printer 10 that can delay rise of output of the laser light and thereby avoid the influence of a ripple component due to the PWM signal to the laser light output at a time of power-on of the power Vcc, in addition to the effect of the above-described illustrative aspect, switch from the normal mode to the toner-save mode can be performed in a shorter time.

(2) In the above-described illustrative aspect, illustratively the charge stored in each of the reference-voltage generating circuit 42 and in the time-constant circuit 46 is discharged by the discharge circuit 62. The present invention is not limited to this. Essentially, it is only necessary to cause the discharge circuit 62 to discharge the charge stored in at least one of the reference-voltage generating circuit 42 and the time-constant circuit 46. In this case, it is preferable to give the time-constant circuit 46 priority in discharge of the charge stored therein.

Furthermore, the discharge circuit 62 is illustratively controlled by the reset signal Vr or by the enable signal EN commonly for the reference-voltage generating circuit 42 and for the time-constant circuit 46. The present invention is not limited to this. The discharge circuit 62 may be controlled separately for the reference-voltage generating circuit 42 and for the time-constant circuit 46.

(3) While the light output device 20 illustratively includes the interlock switch 22 in the above illustrative aspect, the light output device 20 may exclude the interlock switch 22. Even in this case, deterioration of the output unit such as the laser diode (due to shutdown of the power Vcc and the like) can be suitably prevented.

What is claimed is:

1. A light output device comprising:

an output unit configured to output light from a light source;

a feedback-signal generating unit configured to generate a feedback control signal for maintaining output power of the light at a predetermined value, wherein the feedback-signal generating unit is further configured to generate the feedback control signal in a gradually rising manner and to supply the generated feedback control signal to the output unit so that output power of the light is gradually increased at a time of power-on;

a controller configured to set the predetermined value of the output power and to control output of the output unit;

a discharge circuit configured to discharge a charge stored in the feedback-signal generating unit and to accelerate decrease of the feedback control signal; and a power-voltage monitoring circuit configured to monitor a voltage of the power supplied to the output unit and to detect at least one of shutdown and return of the power, wherein the power-voltage monitoring circuit is further configured to, upon detecting shutdown of the power, controls the discharge circuit and cause discharge of the charge stored in the feedback-signal generating unit.

2. The light output device according to claim 1, wherein:

the feedback-signal generating unit includes a light detecting unit configured to generate a light detection signal corresponding to the output power of the light, and a comparison operation circuit configured to compare a voltage of the light detection signal with a reference voltage and to, when the reference voltage is greater than the voltage of the light detection signal, generates a comparison signal for increasing the output power of the light;

the controller is configured to generate a set signal for setting the reference voltage;

the feedback-signal generating unit includes a reference-voltage generating circuit configured to receive the set signal, gradually raise the set signal in relation to a first time constant, and thereby generate the reference voltage, and a time-constant circuit configured to receive the comparison signal, to gradually raise the comparison signal in relation to a second time constant, to generate the feedback control signal, and to supply the feedback control signal to the output unit; and the power-voltage monitoring circuit controls the discharge circuit upon detection of shutdown of the power and thereby cause discharge of the charge stored in at least one of the reference-voltage generating circuit and the time-constant circuit.

3. The light output device according to claim 2, wherein:

the discharge circuit is controlled commonly for the reference voltage generating circuit and for the time-constant circuit.

4. The light output device according to claim 2, wherein:

the light detecting unit includes a peak hold circuit for holding a peak value of the light detection signal; and the discharge circuit has a faster discharge characteristic than the peak hold circuit.

5. The light output device according to claim 1 further comprising:

an interlock switch provided between a power terminal of the light output device and the output unit, the interlock switch configured to cut off power for the output unit;

wherein:

the power-voltage monitoring circuit is configured to monitor a voltage between the interlock switch and the output unit.

6. The light output device according to claim 1, wherein:

the output unit includes a voltage-current converting circuit for supplying drive current to the light source; and when the power voltage becomes equal to or lower than a predetermined value and thereafter the power voltage is returned, the power-voltage monitoring circuit supplies a reset signal to the voltage-current converting circuit for a predetermined time period, wherein the reset signal resets operation of the voltage-current converting circuit, and the predetermined time period is longer than at least a time wherein the controller can detect shutdown of the power.

7. The light output device according to claim 6, wherein:

when the controller detects shutdown of the power, the controller supplies a disenable signal to the voltage-current converting circuit and to the discharge circuit, wherein the disenable signal deactivates the operation of the voltage-current converting circuit, and the disenable signal causes the discharge circuit to execute a discharge function.

8. The light output device according to claim 4, wherein:

the output unit includes a high-speed modulation circuit for generating a modulation signal with use of a data signal supplied from the controller, wherein the modulation signal drives the light source;

each of the comparison operation circuit and the peak hold circuit includes an operational amplifier; and at least the discharge circuit, the power-voltage monitoring circuit, the high-speed modulation circuit, and the operational amplifiers are integrated in a single integrated circuit.

9. An image forming apparatus comprising:

a light output device having;

an output unit configured to output light from a light source;

a feedback-signal generating unit configured to generate a feedback control signal for maintaining output power of the light at a predetermined value, wherein the feedback-signal generating unit is further configured to generate the feedback control signal in a gradually rising manner and to supply the generated feedback control signal to the output unit so that output power of the light is gradually increased at a time of power-on;

a controller configured to set the predetermined value of the output power and to control output of the output unit;

a discharge circuit configured to discharge a charge stored in the feedback-signal generating unit and to accelerate decrease of the feedback control signal; and a power-voltage monitoring circuit configured to monitor a voltage of the power supplied to the output unit and to detect at least one of shutdown and return of the power, wherein the power-voltage monitoring circuit is further configured to, upon detecting shutdown of the power, control the discharge circuit and cause discharge of the charge stored in the feedback-signal generating unit;

an image forming mechanism configured to form an image with use of light outputted from the output unit of the light output device;

a cover configured to open and close to allow access to the image forming mechanism; and a power switching unit configured to shut down the power in accordance with opening of the cover and return the power in accordance with closure of the cover.

10. The image forming apparatus according to claim 9 further comprising:

a normal mode for performing normal printing operation; and a toner save mode for reducing toner consumption;

wherein:

the controller switches between the normal mode and the toner save mode by changing a setting of the reference voltage; and when changing the setting of the reference voltage, the controller causes the discharge circuit to discharge a charge stored in the feedback-signal generating unit.

* * * * *